US006540067B1

(12) United States Patent
Sellers et al.

(10) Patent No.: US 6,540,067 B1
(45) Date of Patent: Apr. 1, 2003

(54) ICE TRANSPORTING ASSEMBLY, ICE MAKING AND TRANSPORTING SYSTEM AND METHOD FOR TRANSPORTING ICE

(75) Inventors: David Sellers, Newnan, GA (US); Hiroyuki Sugie, Peachtree City, GA (US)

(73) Assignee: Hoshizak America, Inc., South Peachtree, GA (US)

( * ) Notice: Subject to any disclaimer, the term of this patent is extended or adjusted under 35 U.S.C. 154(b) by 0 days.

(21) Appl. No.: 09/694,364

(22) Filed: Oct. 24, 2000

(51) Int. Cl.[7] ..... F25G 1/00; B65G 33/14

(52) U.S. Cl. ..... 198/657; 198/661; 198/670; 62/354; 62/320

(58) Field of Search ..... 62/354, 320; 198/661, 198/676, 657

(56) References Cited

U.S. PATENT DOCUMENTS

| | | | | |
|---|---|---|---|---|
| 1,077,810 A | * | 11/1913 | Craggs | 198/661 |
| 3,220,574 A | * | 11/1965 | Sefcheck | 62/354 |
| 3,256,710 A | | 6/1966 | Dedricks et al. | |
| 3,610,482 A | | 10/1971 | Van Steenburgh, Jr. | |
| 3,702,543 A | * | 11/1972 | Lyman | 62/354 |
| 3,869,875 A | | 3/1975 | Verlinden et al. | |
| 3,877,241 A | | 4/1975 | Wade | |
| 3,910,060 A | | 10/1975 | Beusch | |
| 4,104,889 A | | 8/1978 | Hoenisch | |
| 4,250,718 A | | 2/1981 | Brantley | |
| 4,328,681 A | | 5/1982 | Sakamoto et al. | |
| 4,497,184 A | | 2/1985 | Utter et al. | |
| 4,533,310 A | | 8/1985 | Spinner | |
| 4,569,209 A | | 2/1986 | Strauss | |
| 4,574,593 A | | 3/1986 | Nelson | |
| 4,576,016 A | | 3/1986 | Nelson | |
| 4,850,202 A | | 7/1989 | Kito et al. | |
| 5,267,672 A | | 12/1993 | Jacobsen et al. | |
| 5,394,708 A | | 3/1995 | Whinery et al. | |
| 5,542,573 A | | 8/1996 | Frantz | |

* cited by examiner

*Primary Examiner*—Joseph E. Valenza
*Assistant Examiner*—Mark A. Deuble
(74) *Attorney, Agent, or Firm*—Arent Fox Kintner Plotkin & Kahn, PLLC

(57) ABSTRACT

An ice transporting assembly transports ice and includes a sleeve and a tapered auger. The sleeve defines a frusto-conically shaped channel with an inlet having an inlet diameter and an outlet having an outlet diameter less than the inlet diameter. The tapered auger is mounted for rotation within the sleeve and is sized and adapted for positional agreement with the frusto-conically shaped channel. Ice at the inlet is transported through the frusto-conically shaped channel and out of the outlet by rotating the tapered auger about a rotational axis. Another embodiment of the ice transporting assembly includes a reducing sleeve having an upstream conduit section with an upstream conduit diameter, a downstream conduit section with a downstream conduit diameter less than the upstream conduit diameter and a tapered conduit interposing the upstream conduit section and the downstream conduit section. The tapered conduit defines a tapered channel that receives the tapered auger in positional agreement. Another embodiment includes an ice making and transporting system that incorporates the ice transporting assembly. A method for transporting ice from an ice source to an ice destination located remotely from the ice source is also described.

6 Claims, 6 Drawing Sheets

10
16
22
24
20
14
12
18
26
28
R

ICE TRANSPORTING ASSEMBLY, ICE MAKING AND TRANSPORTING SYSTEM AND METHOD FOR TRANSPORTING ICE

FIELD OF THE INVENTION

The inventions relate to transporting ice from an ice source to an ice destination located remotely from the ice source. In particular, the inventions are directed to transporting ice using a tapered auger.

BACKGROUND OF THE INVENTION

Many different types of ice makers are readily available in the marketplace. One type of ice maker uses an auger that is rotatably mounted within a cylindrical chamber of an evaporator. Water is supplied to the cylindrical chamber and the evaporator causes the water to form ice crystals on an inner cylindrical surface of the evaporator. As the auger rotates, the flight of the auger scrapes the ice crystals off the inner cylindrical surface of the evaporator and advances the scraped ice crystals toward an extruding head. As the ice crystals are forced through the extruding head, flaked ice chunks are formed.

An auger-typed ice maker can have the auger disposed within its evaporator in either a vertical orientation or a horizontal orientation. Examples of vertical auger-type ice makers are disclosed in U.S. Pat. No. 4,497,184 to Utter et al., U.S. Pat. No. 4,576,016 to Nelson and U.S. Pat. No. 5,394,708 to Whinery et al. For each of these examples, the ice scraped from the inner surface of the evaporator by the auger is transported to the top of the evaporator at the top end of the flight. From this point, the ice is typically discharged horizontally.

Examples of horizontal auger-type ice makers are described in U.S. Pat. No. 5,267,672 to Jacobsen et al. and U.S. Pat. No. 4,533,310 to Spinner. The auger used in Spinner has a helical flight that is defined in part by an imaginary cylindrical surface and in part by an imaginary frusto-conical surface. As the helical flight scrapes the ice off the evaporator, the ice is advanced along the imaginary cylindrical surface and through the imaginary frusto-conical surface while simultaneously being extruded. The extruded ice is then discharged horizontally.

In Jacobsen et al., a rotatable auger is disposed horizontally within an ice chest and directs ice through an opening into a tubular conduit. A flexible looped cable extends through the tubular conduit and plastic paddles are fixed to the cable at spaced intervals. The paddles contact the ice received within the conduit and advance the ice through the conduit to an overhead destination. Again, the ice is discharged from the auger horizontally. However, soon thereafter, a paddle device transports the ice overhead i.e. vertically.

U.S. Pat. No. 4,328,681 to Sakamoto et al. teaches an ice maker that uses a vertically-oriented evaporator and an auger vertically disposed therein. The ice produced by the ice maker of Sakamoto et al. is continuously transported from the evaporated vertically through a flexible pipe to an ice-storing chamber positioned above the evaporator. The ice is continuously transported as a result of the rotational movement of the auger.

Although auger-type ice makers are effective in producing ice, current auger-type ice makers have not been used to transport ice to destinations that are located remotely therefrom. However, there are ice transporting systems available in the marketplace that can be used in conjunction with any type of ice maker. Such ice transporting systems are described as examples in U.S. Pat. No. 3,877,241 to Wade and U.S. Pat. No. 4,104,889 to Hoenish.

Wade discloses an ice transporting system for an ice maker that transports ice to any one of a plurality of ice storage bins by means of a flowing body of fluid such as pressurized air. Hoenish teaches an ice transporting system that transports ice from a first location to one or more remote second locations that are connected to each other with a conduit system. A source of air causes the ice to move through the conduit system from one location to the other locations. Although these ice transporting systems are effective in transporting ice from an ice source to a remote ice destination, supplementing an auger-type ice maker with such a system requires significant capital equipment and expenditure.

OBJECTS AND SUMMARY OF THE INVENTION

It is an object of the invention to provide an ice transporting assembly and ice making and transporting system that is particularly suitable for auger-type ice makers.

Another object of the invention is to provide an ice transporting assembly and ice making and transporting system that is capable of transporting ice either horizontally or vertically from an ice source to an ice destination located remotely from the ice source.

Yet another object of the invention is to provide an ice transporting assembly and an ice making and transporting system that can be retro-fitted onto existing auger-type ice makers.

A still further object of the invention is to provide an ice transporting assembly and an ice making transporting system using nominal equipment and expenditure.

Accordingly, an ice transporting assembly, an ice making and transporting system and a method for transporting ice of the invention are hereinafter described. One embodiment of the ice transporting assembly of the invention transports ice and includes a sleeve and a tapered auger. The sleeve defines a frusto-conically shaped channel with an inlet having an inlet diameter and an outlet have an outlet diameter less than the inlet diameter. The tapered auger is mounted for rotation within the sleeve and sized and adapted for positional agreement with the frusto-conically shaped channel. Ice at the inlet is transported through the frusto-conically shaped channel and out of the outlet by rotating the tapered auger about a rotational axis.

Another embodiment of the invention is an ice transporting assembly for transporting ice that includes a reducing sleeve and a tapered auger. The reducing sleeve includes an upstream conduit section having an upstream conduit diameter, a downstream conduit section having a downstream conduit diameter which is less than the upstream conduit diameter and a tapered conduit section interposing the upstream conduit section and the downstream conduit section. The tapered conduit section has an interior surface defining a tapered channel. The tapered auger is mounted for rotation within the tapered conduit section and is sized and adapted for positional agreement within the tapered channel. When the ice is advanced through the upstream conduit section and into the tapered conduit section, the ice is transported by the rotating tapered auger through the tapered conduit section and into the downstream conduit section.

Another exemplary embodiment of the invention is an ice making and transporting system that includes an ice making evaporator unit, an ice scraping auger, an extruding unit and an ice transporting assembly as described above. The ice making evaporator unit extends along and about a vertical axis and terminates at a top end. The ice scraping auger is mounted for rotation along and about the vertical axis within the ice making evaporator unit. The extruding unit is connected to the top end of the ice making evaporator unit and includes an immoveable extruding head. The ice scraping auger rotates and scrapes the ice off the ice making evaporator unit and transports the scraped ice into the extruder unit to extrude the scraped ice to form ice chunks. In turn, the ice chunks are transported into the ice transporting assembly where the tapered auger connected to and rotating with the ice scraping auger transports the ice chunks vertically through the tapered conduit section and the downstream conduit section.

Another embodiment of the invention is a method for transporting ice from an ice source to an ice destination that is located remotely from the ice source. One step includes providing a reducing sleeve as described above. Another step is positioning the reducing sleeve above the ice source and in a vertical orientation. Another step is transporting the ice sequentially from the ice source, through the upstream conduit section, the tapered section and the downstream conduit section into the remote ice destination.

Other objects and advantages of the invention will become apparent from the following detailed description of the exemplary embodiments taken in conjunction with the accompanying drawings. dr

BRIEF DESCRIPTIONS OF THE DRAWINGS

DETAILED DESCRIPTION OF THE EXEMPLARY EMBODIMENTS

Figure 1:
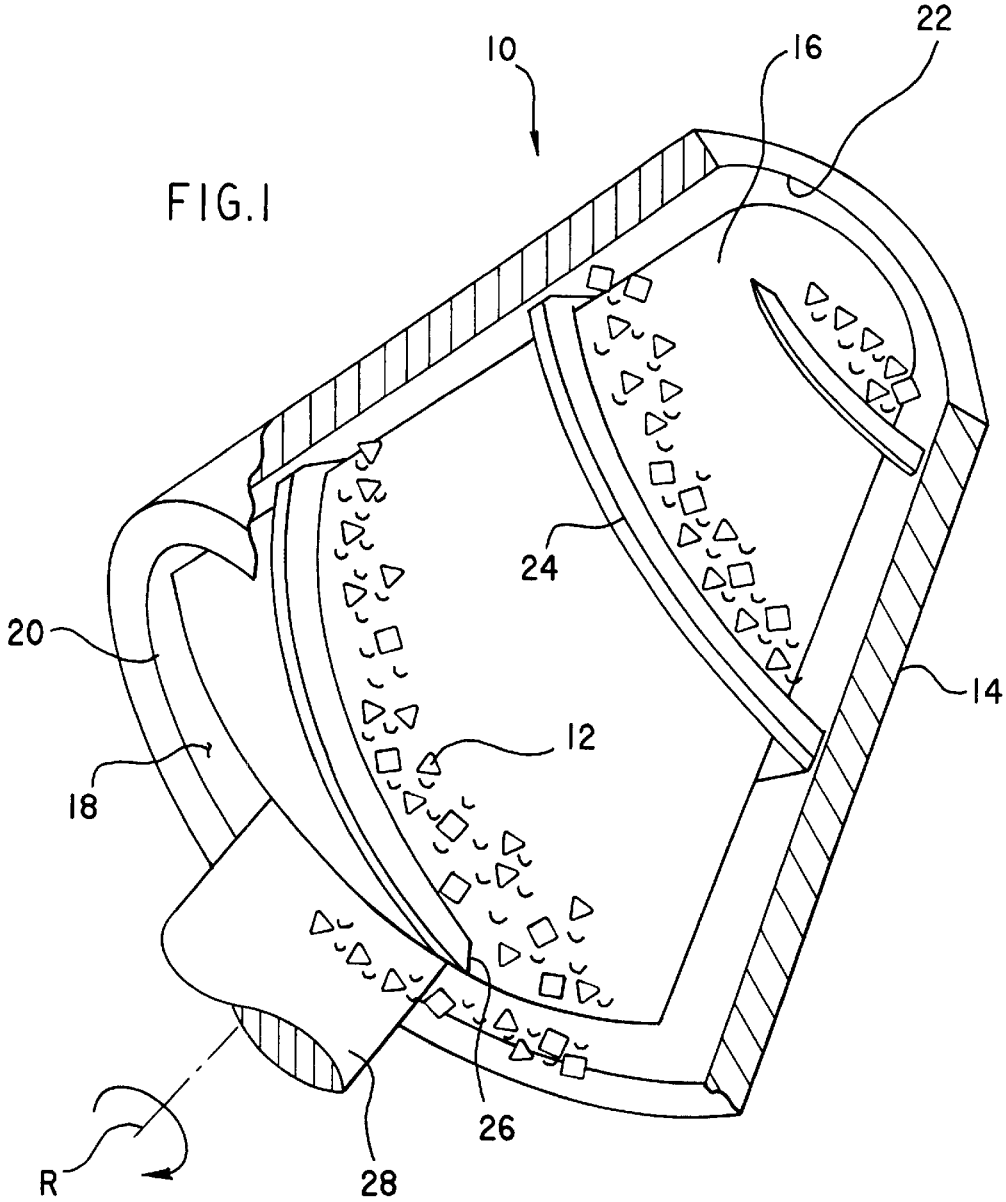
FIG. 1 is a perspective view of a first exemplary embodiment of an ice transporting assembly of the invention.
Figure 2:
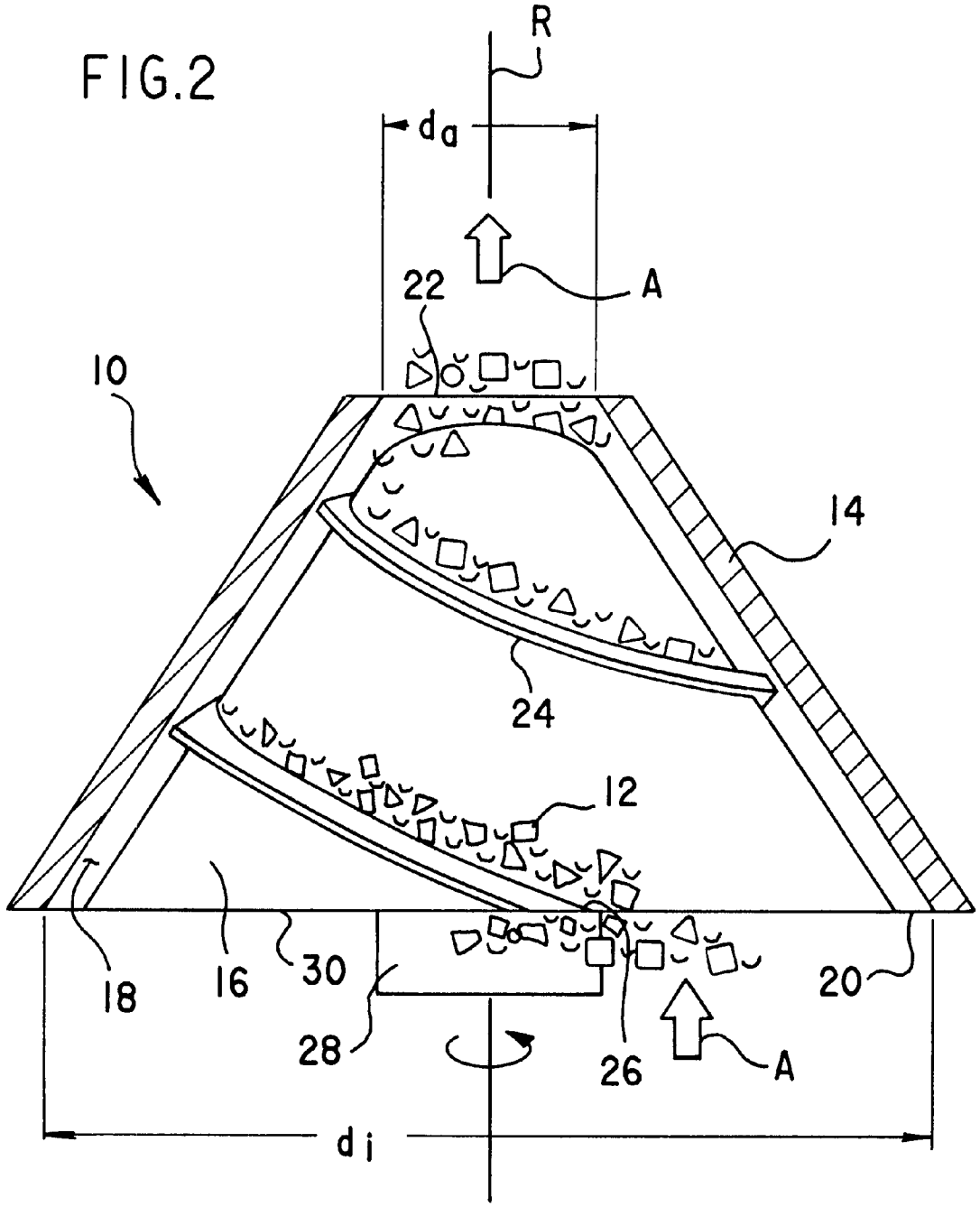
FIG. 2 is a side elevational view partially in cross section of the ice transporting assembly in FIG. 1.

A first exemplary embodiment of an ice transporting assembly 10 of the invention is introduced in FIGS. 1 and 2. The ice transporting assembly 10 of the invention is used for transporting ice 12, particularly in a vertical direction as indicated by the double-dashed line arrows A shown in FIG. 2. The ice transporting assembly 10 of the invention includes a sleeve 14 and tapered auger 16. The sleeve 14 defines a frusto-conically shaped channel 18. For illustration purposes only, the outer configuration of the sleeve 14 is a frustum although one of ordinary skill in the art would appreciate that the outer configuration of the sleeve 14 is not imperative for practicing the invention. The frusto-conically shaped channel 18 extends between an inlet 20 and an outlet 22. In FIG. 2, the inlet 20 has an inlet diameter $d_i$ and the outlet 22 has an outlet diameter $d_o$ that is less than the inlet diameter $d_i$.

The tapered auger 16 is generally conically shaped and is mounted for rotation within the sleeve 14. Further, as shown in FIGS. 1 and 2, the tapered auger 16 is sized and adapted for positional agreement with the frusto-conically shaped channel 18. By rotating the tapered auger 16 about its rotational axis R, the ice 12 at the inlet 20 is transported through the frusto-conically shaped channel 18 and out of the outlet 22.

The tapered auger 16 includes a flight 24 that is connected to the tapered auger 16 and spirals thereabout. The flight 24 commences at the inlet 20 and terminates at the outlet 22. The flight 24 includes a cutting edge 26 that is located at the inlet 20. The cutting edge 26 is operative for cutting ice at the inlet 20 as shown in FIGS. 1 and 2. Although not by way of limitation, the rotational axis. R is oriented vertically, i.e., parallel with the double-dashed line arrows A so that the ice 12 can be transported vertically from the inlet to the outlet 22. Rotational movement of the tapered auger 16 about the rotational axis R is imparted by a drive shaft 28 that is connected to the tapered auger 16, preferably at its broad flattened surface 30 at or near the inlet 20 and centrally about the rotational axis R.

Figure 3:
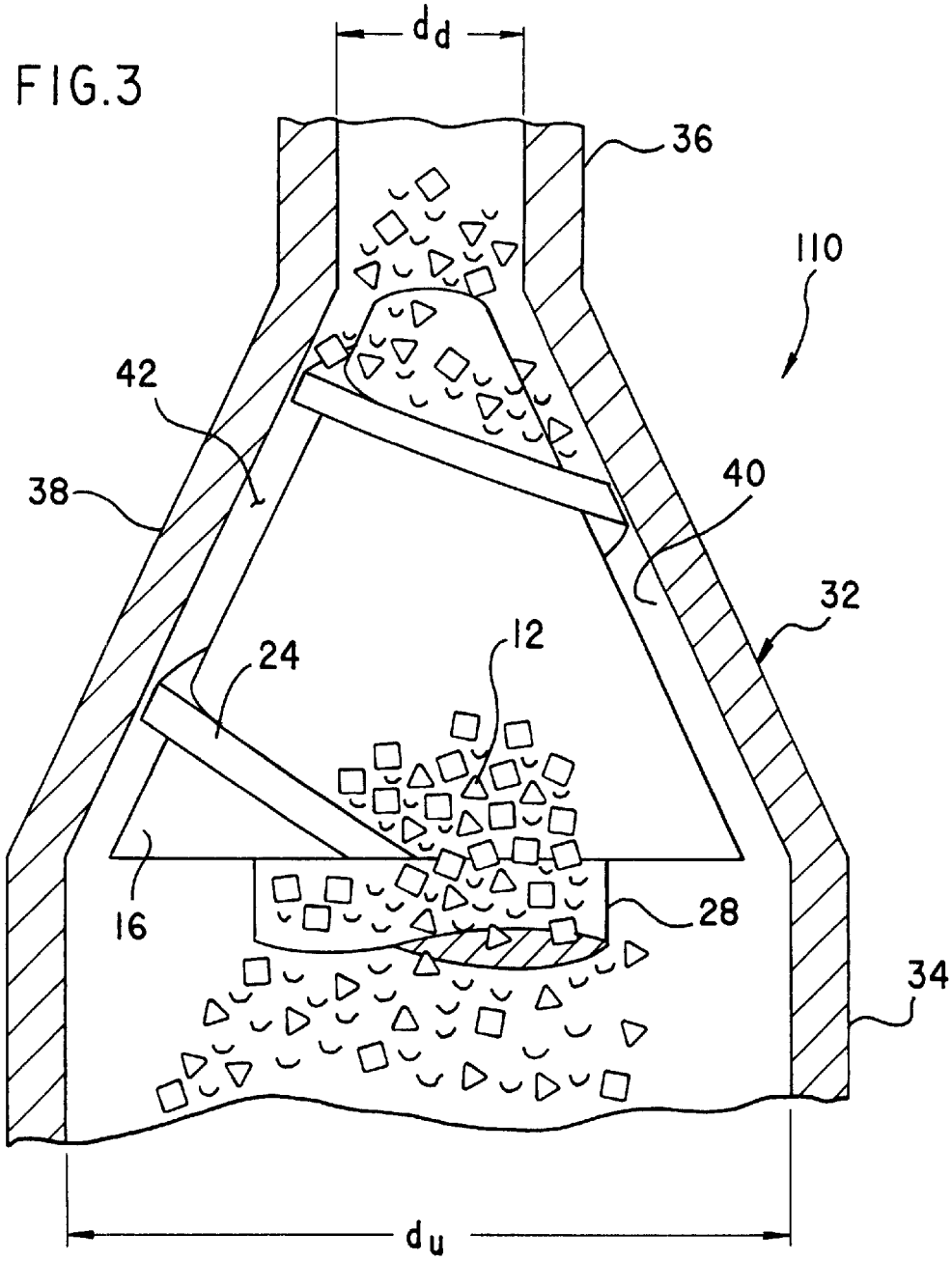
FIG. 3 is a side elevational view partially in cross section of the ice transporting assembly of the invention with a tapered auger with a cutting edge cutting ice chunks.

In FIG. 3, a second exemplary embodiment of an ice transporting assembly 110 of the invention is depicted. The ice transporting assembly 110 of the invention is similar to the first exemplary embodiment described above except that the ice transporting assembly 110 of the invention includes a reducing sleeve 32. The reducing sleeve 32 includes an upstream conduit section 34, a downstream conduit section 36 and a tapered conduit section 38. The upstream conduit section 34 has an upstream conduit diameter $d_u$ and the downstream conduit section 36 has a downstream conduit diameter $d_d$. The downstream conduit diameter $d_d$ of the downstream conduit section 36 is less than the upstream conduit diameter $d_u$ of the downstream conduit section 36. The tapered conduit section 38 interposes the upstream conduit section 34 and the downstream conduit section 36. Also, the tapered conduit section 38 has an interior surface 40 that defines a tapered channel 42.

The tapered auger 16 is mounted for rotation within the tapered conduit section 38 and is sized and adapted for positional agreement with the tapered channel 42. The ice 12 is advanced through the upstream conduit section 34 and into the tapered conduit section 38 which is discussed in more detail below. Once the ice 12 is in the tapered conduit section 38, the ice 12 is transported by the rotating tapered auger 16 through the tapered conduit section 38 and into the downstream conduit section 36.

Figure 4:
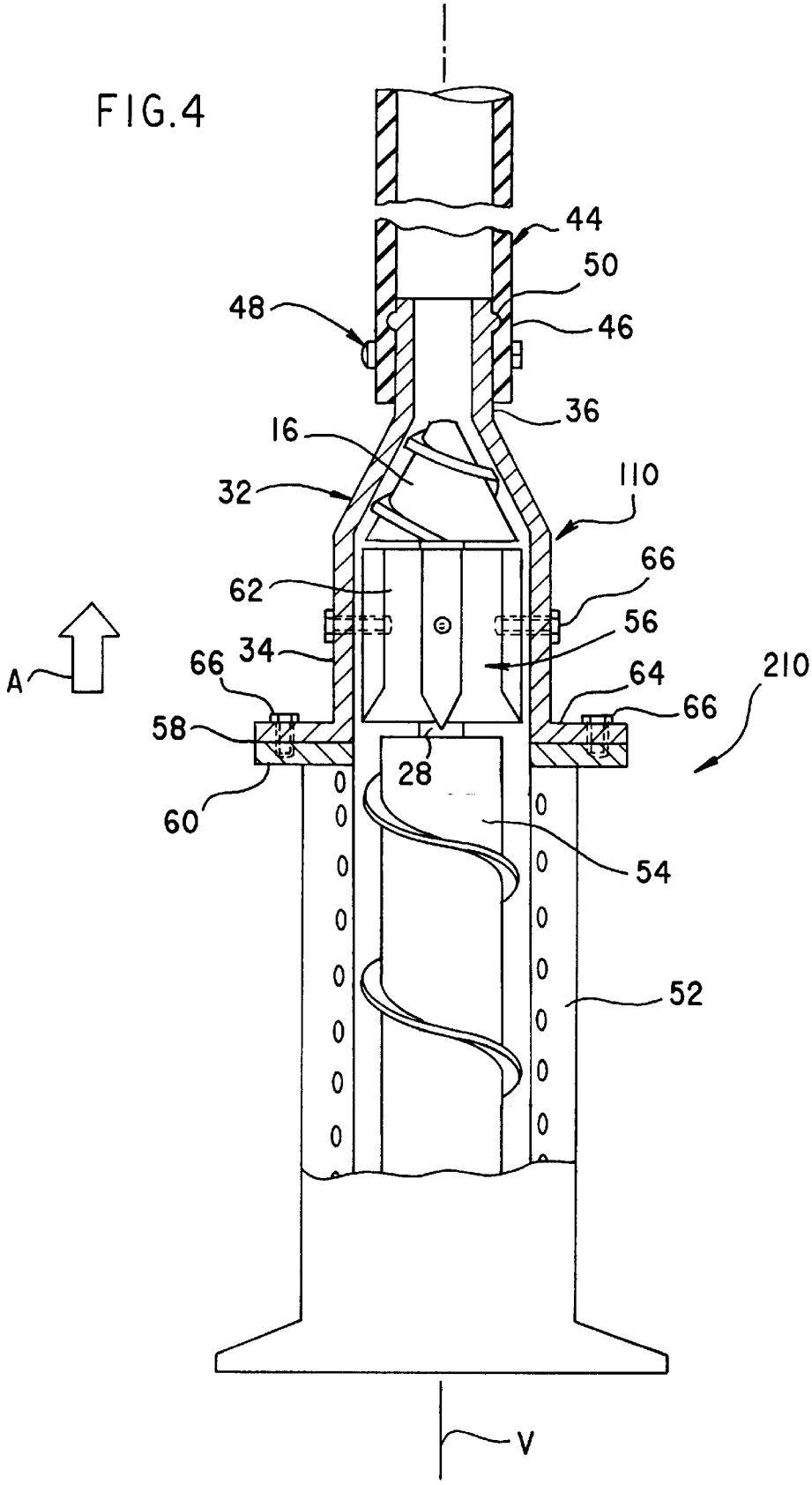
FIG. 4 is a side elevational view partially in cross section of a second exemplary embodiment of an ice transporting assembly of the invention that includes an auger-type evaporator unit and the ice transporting assembly of the invention.

As shown in FIG. 4, the ice transporting assembly 110 of the invention also includes an extension conduit 44. The extension conduit 44 has an end portion 46 that is adapted for releasable connection to the downstream conduit section 36. Although not by way of limitation, the extension conduit 44 is preferably a flexible hose fabricated from any standard material such as pliable metal, rubber or plastic commonly used for hoses. For this second exemplary embodiment of the invention, the downstream conduit section 36 receives the end portion 46 of the extension conduit 44. A conventional clamp 48, such as a hose clamp, releasably connects the end portion 46 of the extension conduit 44 onto the downstream conduit section 36. A rib 50 is connected to the downstream conduit section 36 and extends circumferentially about and projects outwardly from an outer surface of the downstream conduit section 36. The rib 50 helps to secure the end portion 36 of the extension conduit 44 onto the downstream conduit section 36 while simultaneously provides sealing of the connection between the end portion 46 and the downstream conduit section 36.

A third exemplary embodiment of the invention is an ice making and transporting system 210 introduced in FIG. 4. The ice making and transporting system 210 of the invention includes a conventional ice making evaporator unit 52, a conventional, generally cylindrically-shaped ice scraping auger 54, a conventional extruding unit 56 and the ice transporting assembly 110 described above. The ice making evaporator unit 52 extends along and about a vertical axis V and the ice scraping auger 54 is mounted for rotation along and about the vertical axis V within the ice making evaporator unit 52. The ice making evaporator unit 52 terminates at a top end 58 where an evaporator unit flange 60 projects horizontally from and extends circumferentially about the ice making evaporator unit 52. The extruding unit 56 is connected to the top end 58 of the ice making evaporator unit 52. The extruding unit 56 includes a conventional immoveable extruding head 62. A skilled artist would appreciate that the combination of the ice making evaporator unit 52, the ice scraping auger 54 and the extruding unit 56 comprise a conventional auger-type ice maker.

Also, the ice transporting assembly 110 includes an ice transporting assembly flange 64 that is connected to and extends radially from upstream conduit section 34. The ice transporting assembly 110 is connected to the ice making evaporator unit 52 by fastening the ice transporting assembly flange 64 to the evaporator unit flange 60 by conventional fasteners 66 such as bolts. However, a skilled artisan would appreciate that other conventional means can be used to connect the ice transporting assembly 110 to the ice making evaporator unit 52. Note that the ice transporting assembly 110 extends vertically relative to the ice making evaporator unit 52. The upstream conduit section 34 is sized to receive the immoveable extruding head 62. Specifically, the immoveable extruding head 62 is bolted to the upstream conduit section 34 by the conventional fasteners 66 such as bolts.

Figure 5:
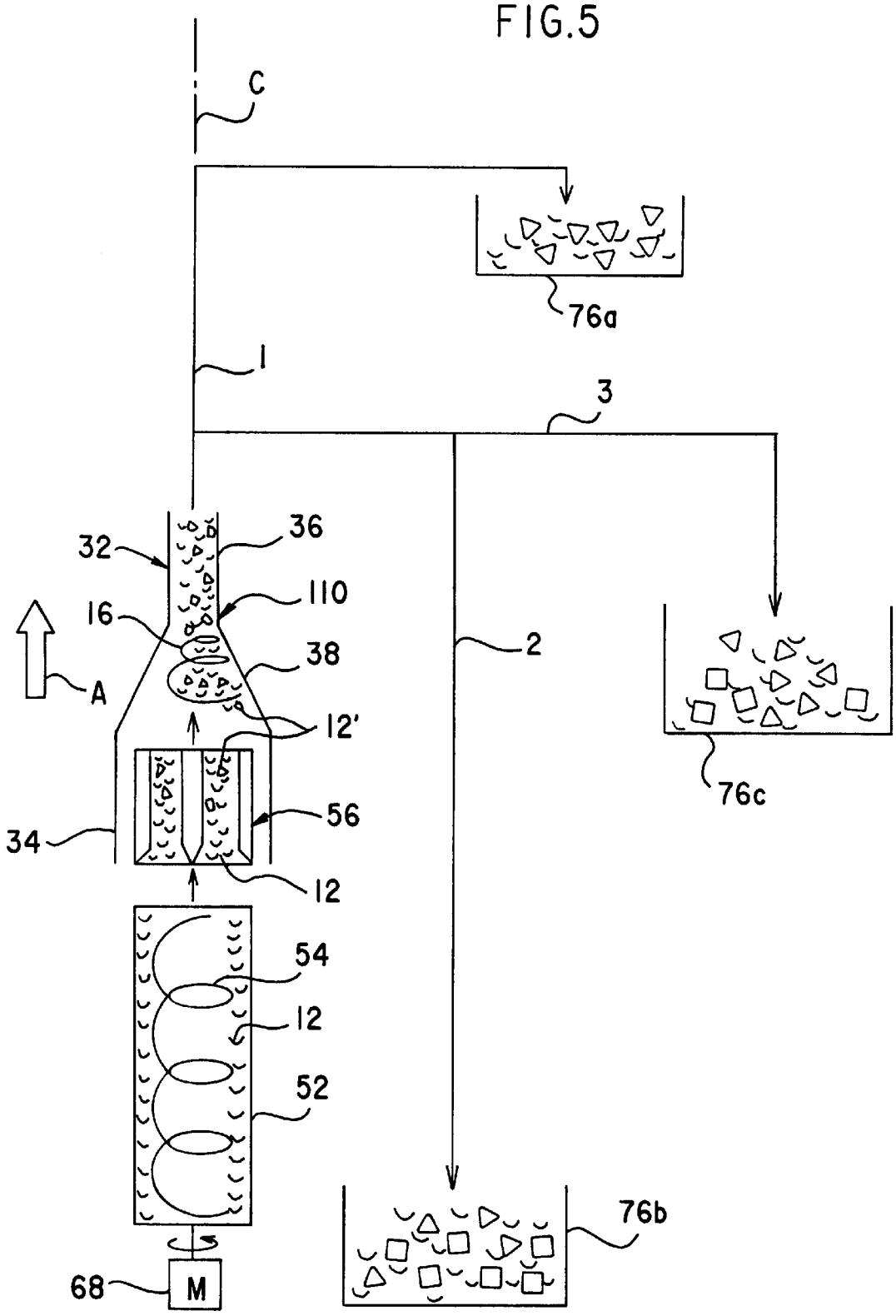
FIG. 5 is a diagrammatical view of the ice making and transporting system of the invention illustrating how ice made in an auger-type ice maker flows through the system into various vertical and horizontal ice destinations located remotely from the ice maker.

As best shown in FIG. 5, the ice scraping auger 54 rotates within the ice making evaporator unit 52 by a motor 68 and scrapes the ice 12 off of the ice making evaporator unit 52 and transports the scraped ice 12 into the extruder unit 56 to extrude the scraped ice 12 to form ice chunks 12'. Subsequently, the ice chunks 12' are transported into the ice transporting assembly 110. Here, the tapered auger 16 which is connected to and rotates with the ice scraping auger 54, transports the ice chunks 12' vertically through the tapered conduit section 38 and the downstream conduit section 36.

Figure 6:
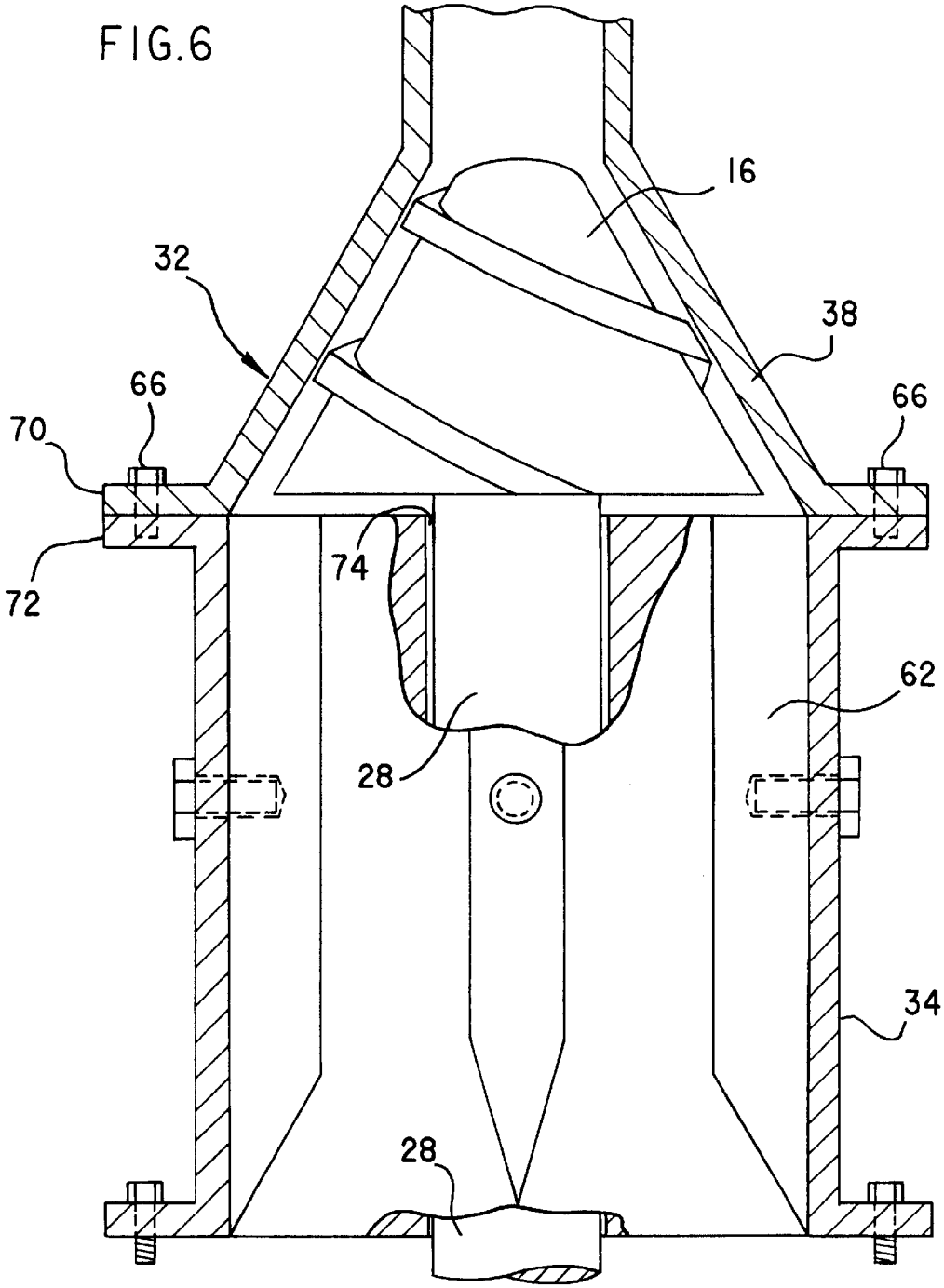
FIG. 6 is a side elevational view partially in cross section showing an ice transporting assembly with a detachable upstream conduit section.

In FIG. 6, the upstream conduit section 34 is shown releasably connected to the tapered conduit section 38 of the reducing sleeve 32 by facially opposing flanges 70 and 72 fastened together by conventional fastener 66 such as bolts. This manner of connecting the upstream conduit section 34 to the tapered conduit section 38 is shown by way of example only and other ways of connecting these components together are known in the art. One of ordinary skill in the art would appreciate that the sleeve 14 can be an integral construction as shown in FIG. 4 or that the downstream conduit section 36 can be releasably connected to the tapered conduit section 38 regardless how the upstream conduit section 34 is connected to the tapered conduit section 38. Also, as best shown in FIG. 6, the extruding head 62 includes a shaft receiving channel 74 that slidably receives the drive shaft 28 so that the tapered auger 16 and the ice scraping auger 54 (FIG. 4) are connected together for simultaneous rotation.

Again, with reference to FIG. 5, a method of the invention for transporting ice 12 and 12' from an ice source such as the ice making evaporator unit 52 in combination with the extruding unit 56 to ice destinations such as ice storage bins 76*a*–76*c* which are located remotely from the ice source. One step is providing the reducing sleeve 32. The reducing sleeve 32 extends along and about a straight central axis C.

Another step is causing the upstream conduit section 34 to be in communication with the ice source and the downstream conduit section 36 to be in communication with the ice destinations as indicated by the numbered solid lines 1–3. Another step is positioning the tapered conduit section 38 above the ice source with the straight central axis C oriented vertically as indicated by the double-dashed line arrow A. The next step is transporting the ice 12 and 12' sequentially from the ice source, through the upstream conduit section, the tapered conduit section and the downstream conduit section and to the remotely located ice destinations.

A skilled artist would appreciate that the extension conduit 44 (FIG. 4) is represented by the numbered solid lines 1–3 to define ice flow paths and is used to deliver the ice to the remote locations. Along the ice flow path 1, the ice storage bin 76*a* is located vertically above the ice source. For example, the ice storage bin 76*a* might be located one or two floors above the ice maker. Ice can also be transported along the ice flow path 2 to the ice storage bin 76*b* which is located below the ice source. For example, the ice storage bin 76*b* might be located one floor below the ice maker. Also, the ice can be transported along the ice path 3 to the ice storage bin 76*c* which can be located anywhere between the ice storage bins 76*a* and 76*b*. For example, the ice storage bin 76*c* might be located on the same floor as the ice maker but in a different room.

Note that the ice is transported from the ice source through the upstream conduit section into the taper conduit section by the ice scraping auger 54 which is considered a first ice transporting device. The ice is then transported through the taper conduit section and the downstream conduit section to the ice destination by the tapered auger 16 considered to be a second ice transporting device. Preferably, the first and second ice transporting devices are rotatably connected to each other such that rotating either the first or second ice transporting device causes a remaining one of the first and second transporting devices to rotate.

A skilled artist would appreciate that the inventions are particularly suitable for auger-type ice makers regardless of the auger being oriented vertically or horizontally. Also, the inventions are capable for transporting ice either horizontally or vertically to remotely located ice destinations. Further, it is appreciated that the inventions can be retrofitted onto existing auger-type ice makers. Also, the inventions can be realized using nominal equipment and nominal capital expenditure.

It will be recognized by one of ordinary skill in the art that changes may be made to the above-described exemplary embodiments of the invention without departing from inventive concepts thereof. It is understood, therefore, that the inventions are not limited to the particular exemplary embodiments disclosed but are intended to encompass any modifications within the scope and spirit of the inventions.

We claim:

1. An ice transporting assembly for transporting ice, comprising:

a sleeve defining a frusto-conically shaped channel with an inlet having an inlet diameter and an outlet having an outlet diameter less than the inlet diameter; and a tapered auger mounted for rotation within the sleeve and sized and adapted for positional agreement with the frusto-conically shaped channel so that the ice at the inlet is transported through the frusto-conically shaped channel and out of the outlet by rotating the tapered auger about a rotational axis, wherein the tapered auger includes a flight connected thereto and spiraling thereabout, the flight commencing at the inlet and terminating at the outlet, wherein a rotational axis of the tapered auger is oriented vertically, and wherein the flight includes a cutting edge located at the inlet and operative for cutting the ice.

2. An ice transporting assembly for transporting ice, comprising:

a reducing sleeve including an upstream conduit section having an upstream conduit diameter, a downstream conduit section having a downstream conduit diameter less than the upstream conduit diameter and a tapered conduit section interposing the upstream conduit section and the downstream conduit section, the tapered conduit section having an interior surface defining a tapered channel;

a tapered auger mounted for rotation within the tapered conduit section and sized and adapted for positional agreement with the tapered channel so that, when the ice is advanced through the upstream conduit section and into the tapered conduit section, the ice is transported by the rotating tapered auger through the tapered conduit section and into the downstream conduit section; and an extension conduit having an open end portion adapted for releasable connection to the downstream conduit section, wherein the tapered auger includes a flight connected thereto and spiraling thereabout, the flight commencing at an inlet and terminating at an outlet, and wherein a rotational axis of the tapered auger is oriented vertically.

3. An ice transporting assembly according to claim 2, wherein the tapered auger includes a drive shaft connected to the tapered auger and operative for imparting rotational movement to the tapered auger.

4. An ice transporting assembly according to claim 2, wherein the extension conduit is a flexible hose.

5. An ice transporting assembly according to claim 2, further comprising a clamp for releasably connecting the end portion of the extension conduit onto the downstream conduit section.

6. An ice transporting assembly according to claim 2, wherein the downstream conduit section includes a rib projecting outwardly from the downstream conduit section and extending circumferentially thereabout.

* * * * *

UNITED STATES PATENT AND TRADEMARK OFFICE

CERTIFICATE OF CORRECTION

PATENT NO. : 6,540,067 B1
DATED : April 1, 2003
INVENTOR(S) : Sellers et al.

It is certified that error appears in the above-identified patent and that said Letters Patent is hereby corrected as shown below:

Title page,
Item [73], Assignee, "Hoshizak America, Inc., South Peachtree, GA (US)" to
-- Hoshizaki America, Inc., Peachtree City, GA (US) --.

Signed and Sealed this

Fourteenth Day of October, 2003

JAMES E. ROGAN
*Director of the United States Patent and Trademark Office*